US006127007A

United States Patent [19]

Cox et al.

[11] Patent Number: 6,127,007

[45] Date of Patent: Oct. 3, 2000

[54] INFRARED CAMOUFLAGE COVERING

[75] Inventors: Philip R. Cox, Madison; Jerry C. Edwards, Huntsville; Jody S. Loyd, Huntsville; Larry Watkins, Huntsville, all of Ala.

[73] Assignee: Teledyne Industries, Inc., Los Angeles, Calif.

[21] Appl. No.: 09/012,722

[22] Filed: Jan. 23, 1998

Related U.S. Application Data

[63] Continuation of application No. PCT/US97/09044, May 29, 1997, which is a continuation-in-part of application No. 08/655,037, May 29, 1996, abandoned.

[51] Int. Cl.[7] ..... A01N 1/00

[52] U.S. Cl. ..... 428/15; 428/17; 428/919; 2/1; 2/69; 2/84; 2/94

[58] Field of Search ..... 428/15, 17, 919; 2/1, 69, 84, 94

[56] References Cited

U.S. PATENT DOCUMENTS

| | | | |
|---|---|---|---|
| 1,139,642 | 5/1915 | Cox | 2/1 |
| 1,144,150 | 6/1915 | Marcovsky | 2/456 |
| 2,351,142 | 6/1944 | Mitchell | 428/136 |
| 2,911,652 | 11/1959 | Ekman | 2/175.6 |
| 3,069,796 | 12/1962 | Ruter | 428/17 |
| 3,823,418 | 7/1974 | Piper | 2/206 |
| 4,046,939 | 9/1977 | Hart | 95/142 |
| 4,064,305 | 12/1977 | Wallin | 95/142 |
| 4,106,124 | 8/1978 | Green | 2/422 |
| 4,190,696 | 2/1980 | Hart et al. | 2/243.1 |
| 4,285,068 | 8/1981 | Ross | 2/202 |
| 4,308,882 | 1/1982 | Pusch et al. | 135/93 |
| 4,375,488 | 3/1983 | Hogan | 428/17 |
| 4,495,239 | 1/1985 | Pusch et al. | 428/919 X |
| 4,517,230 | 5/1985 | Crawford | 428/17 |
| 4,529,633 | 7/1985 | Karlsson | 428/17 |
| 4,560,595 | 12/1985 | Johansson | 428/17 |
| 4,615,921 | 10/1986 | Johansson | 428/17 |
| 4,621,012 | 11/1986 | Pusch | 442/228 |
| 4,656,065 | 4/1987 | Yacovella | 428/17 |
| 4,743,478 | 5/1988 | Pusch | 428/17 |
| 4,868,019 | 9/1989 | Knickerbocker | 428/17 |
| 4,931,320 | 6/1990 | Leonard | 428/17 |
| 5,013,375 | 5/1991 | Leonard | 428/17 X |
| 5,077,101 | 12/1991 | Conway | 428/17 |
| 5,079,048 | 1/1992 | Anitole | 428/17 |
| 5,091,996 | 3/1992 | Kirby | 2/206 |
| 5,159,718 | 11/1992 | Moyer | 2/69 |
| 5,274,848 | 1/1994 | Shamblin | 2/69 |
| 5,281,451 | 1/1994 | Reynolds | 428/17 |
| 5,281,460 | 1/1994 | Cox | 428/919 X |
| 5,347,659 | 9/1994 | Tibljas | 2/243.1 |
| 5,532,052 | 7/1996 | Eng et al. | 442/314 |
| 5,652,963 | 8/1997 | Davison | 2/206 |

FOREIGN PATENT DOCUMENTS

| | | |
|---|---|---|
| 2252431 | 5/1974 | Germany . |
| 1605131 | 12/1981 | United Kingdom . |
| WO 95/08435 | 3/1995 | WIPO . |
| WO 97/45693 | 12/1997 | WIPO . |

OTHER PUBLICATIONS

*Combat Mission* Magazine, Sep. 1988, pp. 9–10: "SNIPER".

*Commerce Business Daily*, Issue No. PSA–0555,Mar. 19, 1992, Naval Regional Contrcting Center, A—Developemnt and Testing of Passive Thermal Suppression Suit Sol N00600–92–R–2493/PE2 POC.

*Primary Examiner*—Cathy F. Lam

*Attorney, Agent, or Firm*—Smith, Gambrell & Russell, LLP

[57] ABSTRACT

A camouflage covering having a porous underlayer such as a knit mesh of 90% open area, and a plurality of dangling elements each having a base portion that is joined to and extends essentially transversely out from the porous underlayer. The dangling elements are arranged so as to essentially cover the porous underlayer so as to present a covering that has depth and provides a loft effect. The dangling elements are preferably strips having a low emissivity (0.02–0.50) inner layer and an external coating, which is thermally transparent but supports pigments that provide a visual and near infrared radiation signature suppression effect.

42 Claims, 8 Drawing Sheets

FIG. 10A
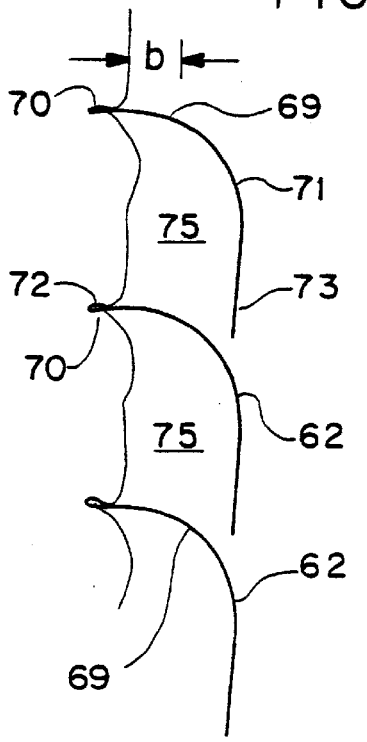
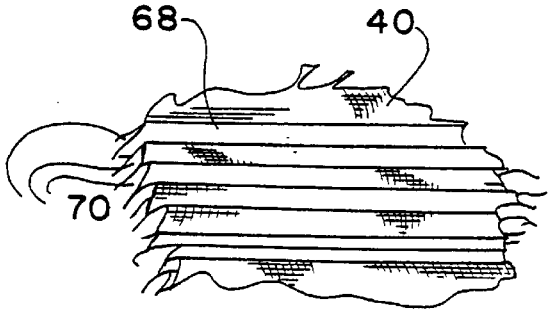
FIG. 10B
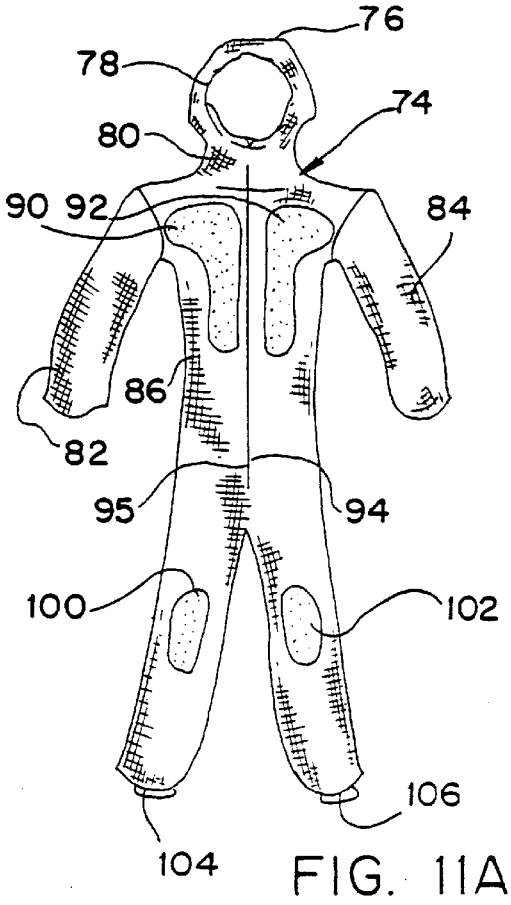
FIG. 11A
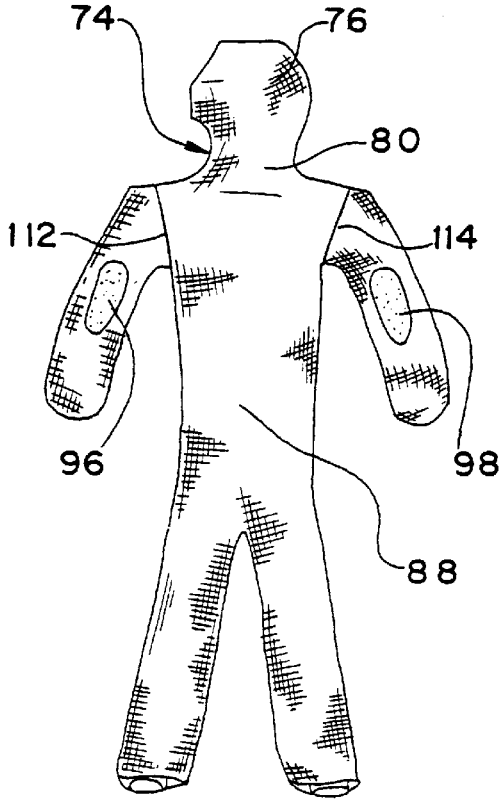
FIG. 11B

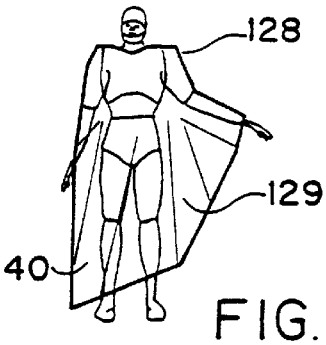
FIG. 14A
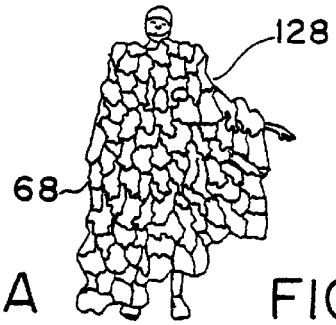
FIG. 14B
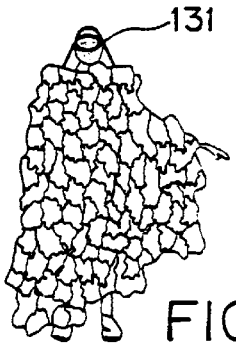
FIG. 14C
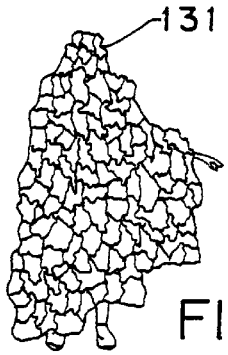
FIG. 14D
FIG. 14E
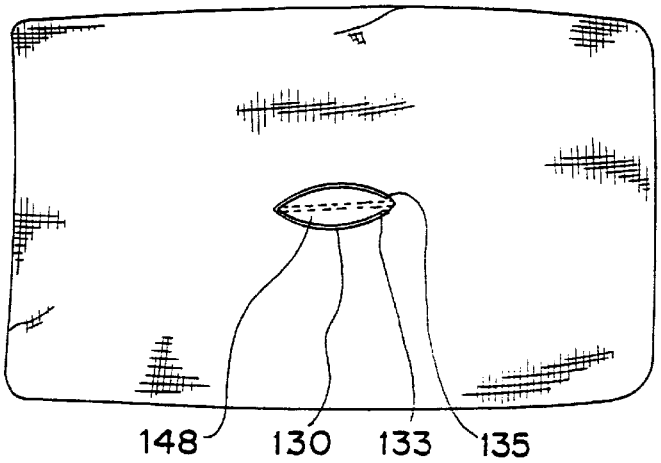
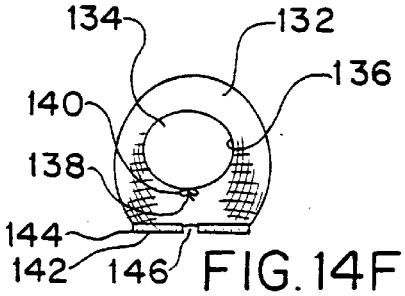
FIG. 14F
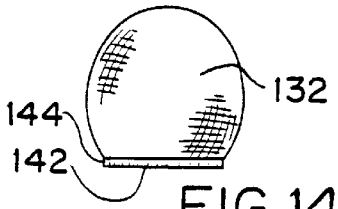
FIG. 14G FIG. 17
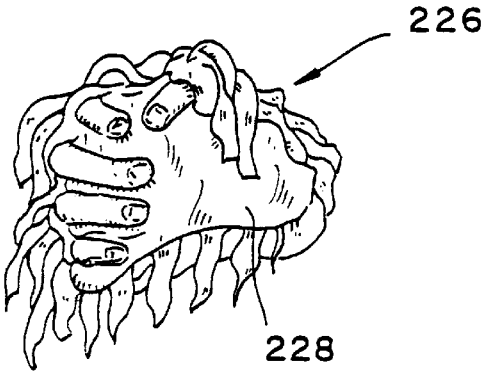
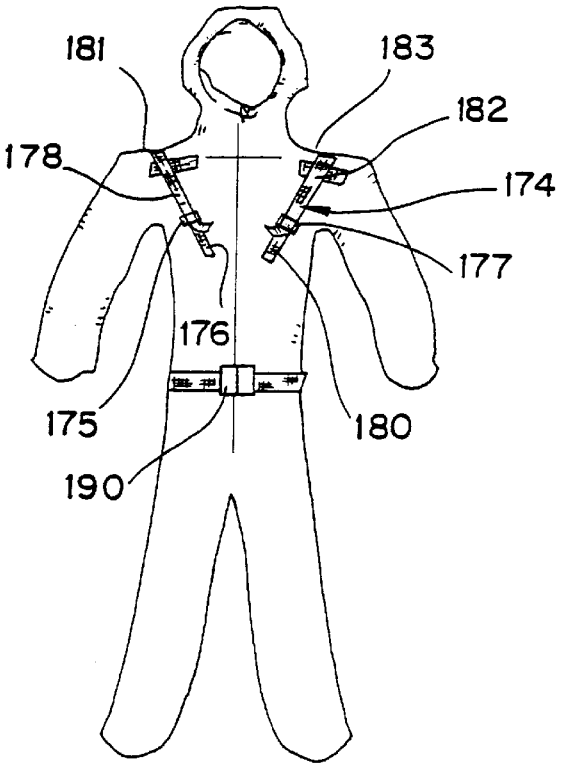
FIG. 18A
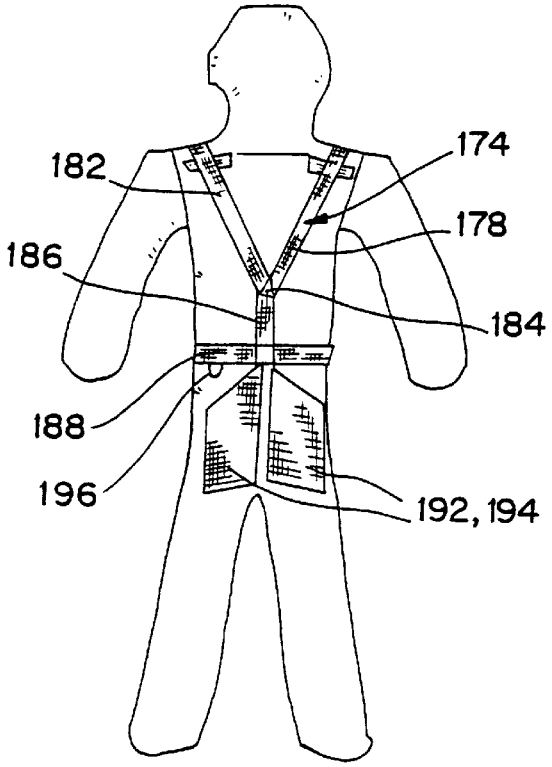
FIG. 18B

INFRARED CAMOUFLAGE COVERING

CROSS-REFERENCE TO RELATED APPLICATION(S)

This application is a continuation of PCT Application PCT/US97/09044 filed May 29, 1997 (Published as International Publication No. WO 97/45693) which is a continuation-in-part application of U.S. patent application Ser. No. 08/655,037 filed on May 29, 1996 now abandoned, each of which is incorporated herein by reference in its entirety.

FIELD OF THE INVENTION

The present invention is directed at a camouflage covering which, particularly for humans, provides multispectral signature suppression over the visible, near infrared, and thermal infrared portions of the electromagnetic radiation spectrum.

BACKGROUND DISCUSSION

Camouflage coverings discussed in tie prior art fail to provide an effective, passive means for suppression of the wearer's thermal (heat) signature without inducing heat stress in the wearer. The primary methods relied upon in the prior art include (1) active movement of air by means of blowers, fans, etc.; and (2) changing only the emissivity of traditionally-sewn garments so that the heat emission of the clothing is reduced.

Both of these techniques have serious drawbacks. For instance, active movement of air under a camouflage covering, produced by a blower or the like, is effective in mixing ambient air with that heated by the body, or in forcing ambient air through the fabric of the covering—thus keeping it cool by way of forced convection. However, this technique has the disadvantage of requiring the user of the covering to carry a power source to run the blower which, in addition to adding weight and reducing mobility, introduces the possibility of a failure at a time when the blower is needed for protection and/or presenting one additional heat source which can be detected by thermal sensors or the like.

The changing of the covering fabric's emissivity can reduce the apparent temperature of the wearer's clothing, but greatly reduces the amount of heat the wearer can dump to the environment—resulting in rapid heating of the wearer and heat stress. Because of this, the prior art low emissivity garments can only be worn for short periods of time, especially during heavy work. An example of a low emissivity material can be seen in the reflective suits worn by firemen and crash rescue personnel. High outside temperatures can be withstood by the wearer, but the suit can only be worn for a few minutes at a time due to the thermal heat build up of the wearer's own heat reflecting back off from the suit.

In addition, the prior art does not consider the simultaneous suppression of the near infrared signature of the wearer simultaneously with suppression of thermal and visual signatures. Near infrared suppression is important in defeating observation and detection by image intensified night viewing devices such as night vision goggles.

The prior art also suffers from the drawback of failing to provide a camouflage material that can easily be tailored to conform with the desired use such as the mission to be performed and the equipment requirements of the wearer during that particular mission. The prior art also fails to adequately maintain protection while allowing the wearer to access equipment being carried. Further, the prior art fails to provide protection from multispectral sensing in many areas of the wearer such as in the hand and face area which involves consideration of how a covering might change in position during use. The prior art also fails to adequately provide a covering which can be easily reconfigured or adjusted on the wearer such that a standard design is applicable to a wide assortment of wearer body dimensions.

U.S. Pat. No. 5,281,460 and PCT application no. PCT/US93/09114, which share a common inventor with the present application, represent an initial step in solving many of the numerous problems presented by the state of the art. The present invention, which came about following extensive testing and modifications in the infrared camouflage covering described in U.S. Pat. No. 5,281,460 and PCT application no. PCT/US93/09114, however, features some significant improvements over the covering described in the '460 patent and PCT application particularly with respect to enhancing the signature suppression effects of the covering over a wide range in the electromagnetic radiation spectrum and in making the covering better adapted for a wide variety of uses and circumstances, better able to provide protection against sensing, and more user friendly. U.S. Pat. No. 5,281,460 and PCT application no. PCT/US93/09114 are incorporated herein by reference in their entirety.

SUMMARY OF THE INVENTION

The present invention is directed at providing a solution to the above noted problems and deficiencies in the prior art. In so doing, the present invention features a camouflage covering that includes a porous underlayer and a plurality of dangling elements. Each dangling element has a base portion that is joined to and extends essentially transversely out from said porous underlayer (e.g., no portion of the axial length of the dangling element's base that is in contact with the underlayer extends parallel with the underlayer). The dangling elements are arranged so as to essentially cover the porous underlayer so as to provide a covering that has depth and essentially hides the underlayer from view.

The porous underlayer is a mesh material having at least 35% and preferably more than a 50% planar open area or, even more preferably, a planar open area that is about 90% or greater. Also, the porous underlayer is preferably a knitted fabric.

Despite the large open area of the porous underlayer, the porous underlayer is formed of a material and in a fashion which gives it sufficient strength for shaping or assembling into a personal garment, for example, a one-piece coverall with hood, a two piece coverall with hood, a tunic with hood, and a poncho design.

The personal garment also preferably includes an attachment device positioned on an interior surface of the underlayer which is the surface most adjacent to a wearer of the camouflage covering. In one embodiment of the invention, the attachment device is a size adjustment assembly such as an adjustable shoulder harness and belt combination. An additional attachment device includes one or more closed cell cushions which can be provided at the knees and elbow sections of the garment. Additional attachment devices include elastic straps or the like to ensure maintenance of the garment in position in the areas of the ankles, wrists, knees and elbows for instance.

For added camouflage protection, the personal garment comprises a main body portion for covering at least a chest area of a wearer as well as a mitt which is comprised of the underlayer, a plurality of the dangling elements to cover the back of the hand and, preferably, a non-porous fabric such as a heavy weight canvas for the palm area of the hand.

For still further protection from thermal sensors or other types of detectors, there is provided a mask which includes a face shield that provides visual acuity and thermal suppression of the eyes and at least a portion of a wearer's face. The mask also includes a head securement assembly and a plurality of the dangling elements secured to that assembly. In addition, the face shield includes a vinyl plate and a breath suppression device such as a block of the above noted closed cell foam material and a veil formed of the underlayer material and a plurality of attached dangling elements.

One embodiment of the invent on also features a camouflage covering that includes a removable head covering and an assembly for closing a head opening that normally receives the removable head covering. With this arrangement, the covering can double as a blanket or general object camouflage covering when the head covering is removed and the head opening closed. The dangling elements are preferably strips of material that each have a base portion extending essentially transversely out from said underlayer for a distance of at least ½ inch (1.27 cm) and are of a sufficient length so as to curve and place a free end section essentially perpendicular to the base portion and to cover or at least extend below the level of a base portion of a lower positioned strip.

In the preferred embodiment, strips are formed of a multispectral fabric which includes a thermally transparent outer coating (e.g., an outer coating selected and applied in a manner to maximize the coating's thermal transmissivity) that includes means for matching the strip with visual and near infrared reflectance characteristics of an environmental background in which said covering is to be used. Also, the strips are comprised of a base fabric/metal/outer coating laminate which includes an inner layer (comprised of the base fabric laminate and the metal laminate) that is thermally reflecting for presenting an appearance of lower emissivity when viewed through the thermally transparent outer coating. The inner layer preferably includes a metallic surface for providing the low emissivity value, although the use of other low emissivity value material is also possible. The thermally transparent outer coating includes a binder material and the means for matching the strips with the surrounding environment includes single or multiple color pigments having a particle size below 3 micrometers. The dangling elements and/or porous underlayer is/are formed of a self-extinguishing material or have a flame retardant component included for added safety.

Preferably, the dangling elements are strips having a common base so as to form a dangling element panel, and the common base is secured within a fold of the underlayer. The covering comprises a plurality of the dangling element panels which are secured within a plurality of folds (or one continuous fold) in the underlayer. A plurality of panel supporting folds are preferably arranged so as to form a plurality of parallel ridges on an interior surface of the underlayer. The strips are formed from a common sheet of material forming the panel with a depth of incision between adjacent strips being different within the common sheet and the strips having side edges that are concave and convex. Further, a large sheet can be either cut into a plurality of panels and the strips formed at a subsequent stage or a plurality of the cut panels can be formed simultaneously with the strips in a larger die-cut operation.

The present invention is also directed at a method of forming a camouflage covering which includes securing a plurality of dangling elements to a porous underlayer such that the dangling elements have a base portion that extends directly out perpendicularly to a supporting surface of the underlayer to provide a loft effect and to place the dangling elements in a vertically overlapping relationship with a dangling element positioned therebelow (when the underlayer is oriented vertically). The strips are also placed in an essentially side-by-side abutting relationship due to little or no material being removed during the incision process used to form the dangling elements. A plurality of independent panels, each raving a common edge with the dangling elements extending thereoff, are secured within a plurality of folds in the underlayer which folds are arranged in parallel, spaced fashion.

The method of the invention further comprises forming one or more panels of dangling elements with a common base or selvedge edge along one edge by subjecting a panel of material to an incision operation such as a die cut operation with the incisions extending internally up to the common base. Prior to incision, sheets of the fabric to be formed into the dangling strips are divided into panels. The original base fabric sheets are first covered with the aforementioned low emissivity layer and then an outer coating having a thermally transparent or transmissive binder material with a pigment interspersed within the coating is applied over the low emissivity material to form a base fabric/low emissivity (e.g., metal)/transparent binder material laminate. The pigment inclusion provides the coating with an ability to match the dangling elements with visual and near infrared reflectance characteristics on an environmental background in which the covering is to be used. The low emissivity material acts to reflect the temperature of background objects (trees, ground, rocks, sky, etc.) back to any viewing thermal sensor, thus partially masking the temperature of the wearer of the suit. Upon forming the dangling elements, each dangling element has these detection suppression characteristics.

The camouflage covering of the present invention thus features a porous underlayer with a plurality of dangling strips supported by the porous underlayer with the combination being dimensioned and arranged so as to form a three-dimensional composite fabric that reflects and converts an essential or main direction of thermal radiation from perpendicular to parallel with respect to a plan of an entrance aperture of a thermal sensor and includes a free flow convection space between an interior surface of the dangling strips and an exterior surface of the porous underlayer by way of a loft arrangement in the dangling strips. The loft arrangement features strips that include a base portion that extends essentially transverse with resect to the supporting underlayer for at least ½ inch (1.27 cm) and which features an outer portion that curves away from the base portion and into a parallel arrangement with the supporting underlayer and, thus, as well as with the plan of a thermal sensor. Groups of the strips can thus be provided with each group of strips extending out from a common base section formed of a common material and the groups of strips being joined to the porous underlayer by inserting the common base thereof within one or more folds formed in the porous layer and securing the common base to the fold formed in the porous layer. A preferred embodiment of the invention features a camouflage covering that comprises a porous layer having at least 90% open area, and a plurality of dangling elements supported by said porous layer wherein the porous layer is a knit mesh comprised of multifilament, strands of plastic, and wherein the dangling elements are formed of a flame retardant material. The strips are arranged in sufficient number and position so as to essentially cover the entire surface of the underlayer so much so as to preclude detection by a sensor through not leaving any sufficiently exposed areas. A covering of at least 90% of the underlayer is preferable.

The material forming the dangling strips is overcoated with a thermally-transparent (or thermally transmissive), pigmented coating. This pigmented coating is comprised of a binder of acrylic polymer into which has been added inorganic pigments to provide a visual and near infrared coloration and relativity, a flame retardant material to provide the wearer safety in the presence of fire. Before application, the acrylic binder is combined with a solvent such as water to permit flow of the mixture in the coating process, and emulsifiers to keep all the other constituents in suspension during the mixing and application process. This material can be applied to the dangling strip fabric using a variety of methods, such as foam, roll and knife coating techniques, which are, per se, known in the industry. The coating is dried after application by, for example, passing the coated fabric through a bank of infrared lamps.

BRIEF DESCRIPTION OF THE DRAWINGS

The advantageous nature of the invention summarized above will become more apparent from the following detailed description of the invention and the accompanying drawings in which:

FIG. 10A shows the same view as in FIG. 9 except for the undergarment having been reoriented into a typical vertical use orientation;

FIG. 10B shows a rear view of the undergarment with attached panels in a horizontal, parallel arrangement;

FIG. 11A shows a front elevational view of the undergarment material joined together in the form of a one-piece coverall with hood as well as added pads and patches;

FIG. 11B shows a rear elevational view of the undergarment of FIG. 11A;

FIG. 14A shows a schematic depiction of a poncho embodiment of the present invention in position over the wearer;

FIG. 14B shows a similar depiction as that in FIG. 14A except with added panels such as that shown in FIG. 4;

FIG. 14C shows a similar depiction as that in FIG. 14B except with an added hood in position over the wearer's head;

FIG. 14D shows a rear view of the depiction in FIG. 14C;

FIG. 14E shows a schematic view of the present invention as shown in FIG. 14A with an open hood attachment arrangement shown in fill lines and a closed hood attachment arrangement shown in dashed lines with the latter arrangement representing a blanket or general use covering embodiment of the present invention;

FIG. 14F shows a schematic, front view of the removable hood of the present invention;

FIG. 14G shows a back view of that which is shown in FIG. 14F;

FIG. 17 shows a bottom view of a suppression mit being worn by the wearer;

FIG. 18A shows a schematic, front view of a one-piece, adjustable coverall assembly; and FIG. 18B shows a schematic depiction of the rear view of the adjustable coverall embodiment of FIG. 18A with carrying pockets.

DETAILED DESCRIPTION OF THE PREFERRED EMBODIMENTS

The present invention is comprised of an underlayer which is formed of an open mesh which is preferably a knit fabric. The i)pen mesh should have at least 35% of its planar area open with a range of 50–90% being preferred. Actually, an open area above 90% is even more preferable from a heat dissipation and weight reduction standpoint, but strength and suitability for use of the mesh material as a supporting undergarment make an upper limit of about 90% representative of a preferred level well suited for the purposes of the present invention.

In a preferred embodiment of the present invention, either a single underlayer fabric sheet or a plurality of underlayer fabric sheets are joined together (e.g., segments knitted or threaded together) to serve the basis from which a resultant camouflage garment takes its shape. The camouflage garment of the present invention can be built in a multitude of designs such as a shirt, coveralls, pants, poncho, tunic, combinations thereof, etc.,—depending on the pattern used for the undergarment.

Figure 1:
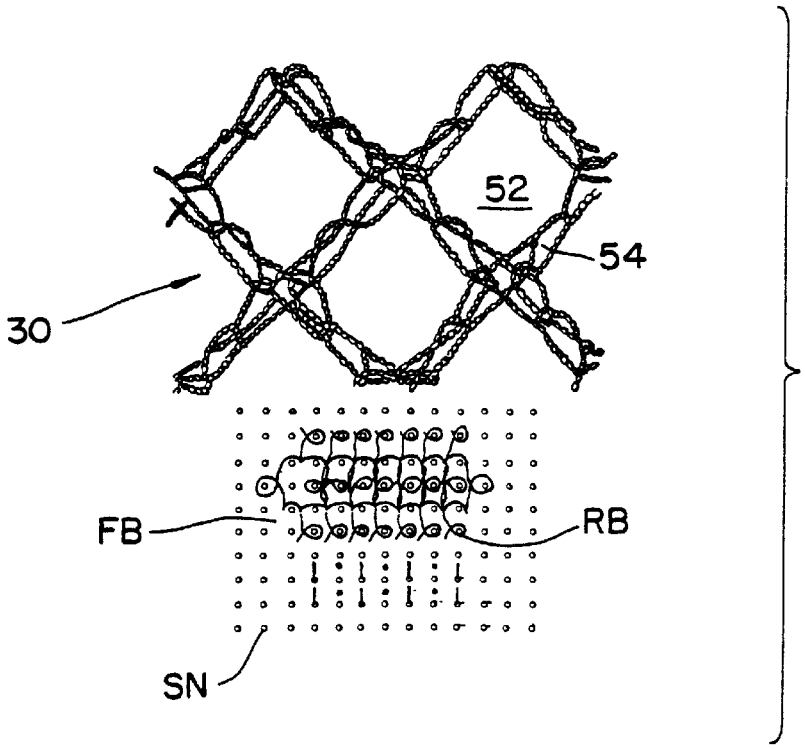
FIG. 1 shows a previously relied upon knitting needle pattern utilized for forming an underlayer suitable for use in the present invention and a cut away section of the fabric produced by that knitting needle pattern.

FIG. 1 illustrates a previously relied upon knitting pattern and a section of the resultant underlayer fabric sheet 30 produced by that knitting pattern which resultant product has a planar open area of 50%. The needle pattern illustrated on sandfly net SN in FIG. 1 shows the front bar pattern FB and the rear bar pattern RB with the front bar having the parameters of (1.0/1.2/2.3/2.1) and the rear bar the parameters of (2.3/2.1/1.0/1.2). The FIG. 1 embodiment features diamond shaped open areas 52 with equal side walls 54 of about 1.0 mm in length. The yarn relied upon to form fabric sheet 30 is a polyester, single filament yarn. This particular form of the underlying sheet is suited for use in the present invention particularly in conjunction with the multispectral suppression panels described below. However, the present invention features an improved underlayer fabric sheet 40 which is shown in FIG. 2.

Figure 2:
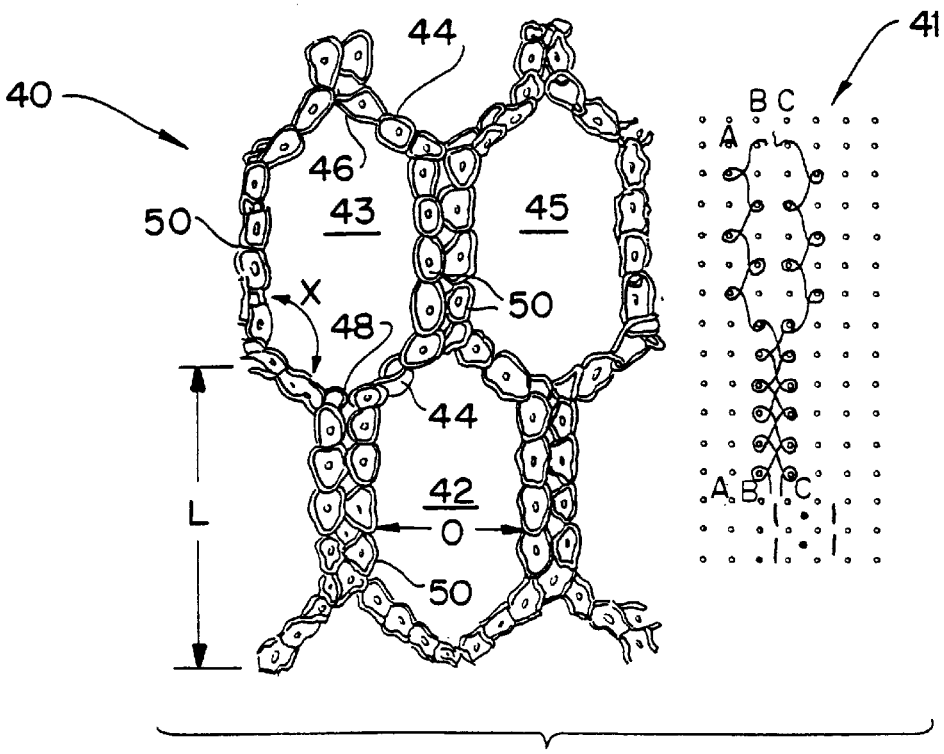
FIG. 2 shows an improved knitting needle pattern for an embodiment of the present invention and a cut away section of the undergarment fabric produced by that pattern.

FIG. 2 shows an improved knitting pattern 41 and the resultant underlayer fabric sheet 40 produced by that design. Underlayer fabric sheet segment 40 shown in FIG. 2 is a mesh having a planar open area of 90%. The openness of the underlayer mesh is important as the openness promotes natural convection of the wearer's body heat through the garment and away from the skin. The more open the undergarment material, the greater the amount of heat convected from the body. The ability of the wearer to readily damp heat to the environment is important from the standpoint of allowing the wearer to wear a suppressive garment formed with the underlayer material for extended periods.

The undergarment formed from the underlayer material serves as the base for attachment of another material, while simultaneously permitting little resistance to the transfer of heat from the wearer. The conversion from the mesh shown in FIG. 1 to the mesh shown in FIG. 2 has decreased the heat experienced by the wearer and also lowered the weight of the material and hence the garment formed from that material. The synergistic effect brought about by the redesign of the underlayer to that shown in FIG. 2 bas also provided increased comfort for the wearer (e.g., less heat build up and less weight to support). The preferred arrangement for underlayer 40 in FIG. 2 features hexagonal shaped openings 42, 43, and 45 defined by single thickness, short walls 44 which intersect at opposite ends of the opening so as to form first apex 46 and second apex 48. The length of each of short walls 44 is preferably about 2–4 mm and the angle for apex 46 and apex 48 is preferably about 120 degrees. Long walls 50 extend between non-intersecting ends of respective short walls 44 for a length of about 4–8 mm so as to form an internal, obtuse angle of about 120 degrees with respect to the contacting short wall. The mesh is formed by forming double thick side walls with one partially defining a first opening 42 and the second partially defining a second opening adjacent the first opening. The width "O" between side walls 50 defining the same opening is about 4–6 mm while the length "L" between apex tips is about 6–8 mm. A variety of other dimensions and arrangements for the walls defining the openings can also be relied upon in achieving the desired open area, but the arrangement of FIG. 2 has proven to be well suited for the purposes of the present invention. As noted above the preferred material for the yarn in FIGS. 1 and 2 is polyester. Various other materials, which are light, high in strength, waterproof and not degrading with respect to multispectral suppression over the visible, near infrared, and thermal infrared regions of the electromagnetic radiation spectrum, are also possible such as nylon and acrylic. The present invention can also include a hybrid multifilament yarn having a mixture of different types of materials which have at least some of the required characteristics described above and when used together achieve all the required parameters to be effective for the purposes set forth herein.

As noted above, the underlayer fabric is required to be of relatively high strength. To maintain the undergarment strength, when moving to the more open fabric of FIG. 2, an increase in the fabric's stiffness was made. This increased fabric stiffness was brought about through the use of a knit fabric formed of a larger diameter multifilament yarn. For example, a preferred size for the polyester, single filament yarn used in the FIG. 1 embodiment was 75 denier and this has been replaced with a multifilament, polyester yarn with a size of 150 denier. The stiffer fabric is easier to handle and sew together and provides greater dimensional stability for the garment. This lack of limpness in the underlayer, among other benefits, makes it easier to put on and take off the garment.

The added dimensional stability in the underlayer material and, hence, the undergarment formed of this material, has provided greater flexibility in the designing of different types of camouflage coverings for personal use. Examples of some preferred personal use camouflage coverings possible with the undergarment material of the present invention can be found in FIG. 11A (one-piece coverall), FIG. 13A (camail), FIG. 14A (poncho) and FIG. 15A (two-piece coverall with pants and shirt). Prior to providing further details of these different embodiments, however, a description of the second major component of the present invention, the multispectral suppression covering material, and a unique manner of attachment of this material to the undergarment is described.

In U.S. Pat. No. 5,281,460, multispectral strips were attached, individually at one end by way of stitching (e.g., a flat lockstitch) directly to the mesh material therebelow. This type of attachment was found to severely limit the number and density of strips that may be incorporated into the suit. It was also discovered that the manner of attachment previously relied upon tended to orient the strips such that some wearer positions showed more thermal signature than others and such that the airflow through and around the suit was hampered. The present invention provides an improved strip attachment technique that lessens to a great extent the problems associated with the previously relied upon strip attachment: techniques. Also in developing the improved attachment technique of the present invention improvements were also made in the dangling strips themselves.

Figure 3:
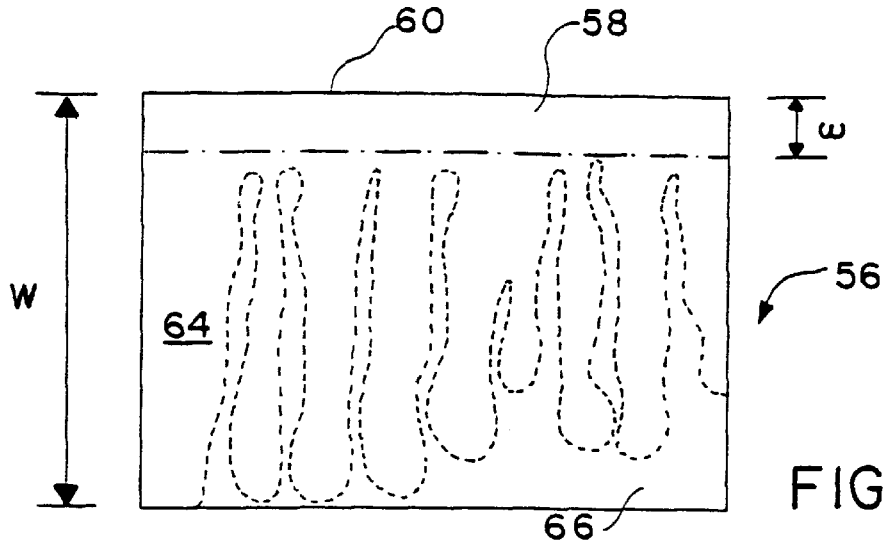
FIG. 3 shows a multispectral protection panel prior to dangling strip formation.

FIGS. 3–10 illustrate the improved dangling strip or element fabrication and attachment techniques, some improved dangling strip configurations and the improved resultant camouflage covering. FIG. 3 illustrates multispectral panel 56 prior to strip formation (pre-strip panel). Pre-strip panel 56 is preferably a metallic coated plastic filament fabric, although other materials providing similar results are also possible. In a preferred embodiment panel 56 is an aluminum-coated nylon or polyester coated fabric with a thermally transparent pigmented coating applied over the metal layer to form a fabric/metal/thermally transmissive material sequence with the fabric being the inner surface closest to the wearer and the thermally transmissive coating being furtherest from the wearer. The thermally transmissive coating is comprised of a binder which features an acrylic polymer mixed with water and ammonia as a solvent therefore. To this binder is added various inorganic pigments and an emulsifier.

The percentage by weight of the ingredients in the coating preferably ranges as follows:

| | |
|---|---|
| Pigment(s) | 35–40% |
| Acrylic Polymer (with water and ammonia solvent) | 20–30 |
| Flame Retardant | 35–40% |
| Emulsifier | .08–.15% |

A more specific example formulation (by weight) for producing a light green, thermally transparent coating is:

| | |
|---|---|
| Ferro 11669 | 37.43% (pigment) |
| Acrylic Polymer (with water and ammonia solvent) | 25.0% (binder) |
| Amsperse 1023P | 37.43% (flame retardant) |
| Methyl Cellulose | .14% (emulsifier) |

Many other colors are available just by replacing the pigment listed with others or by mixing pigments.

A suitable acrylic polymer is available from Sun-Coatings, 12290 73rd Court, North Largo, Fla. 34643 U.S. under the brand name R007 Emulsion which comes in a combination of acrylic polymer, water and ammonia.

The solvent component (e.g., water and ammonia) allows it to be foamed, sprayed, or rolled onto the described fabric. The use of knife over roll and foam techniques to apply the coating to the fabric are preferred in the present application.

The multispectral fabric used for the dangling strips is thus comprised of a woven fabric, such as nylon or polyester, onto which has been deposited a layer of metal. This metal layer can be continuously conductive or not continuously conductive, depending on the desired use. Over this layer—which is reflective to the thermal infrared—is placed the coating having a pigment or pigments chosen for their visual and near infrared reflectance characteristics and the aforementioned thermally-transparent binder. The pigment or pigments are milled before inclusion in the binder until the pigment particle size is much less than thermal infrared wavelengths (<3 $\mu$m). When applied to the fabric, the result is a fabric that is thermally reflective, colored to match environmental backgrounds (green or brown for instance), and simulates the near infrared reflectance (used by many image-intensified night vision devices) of those same backgrounds.

In addition to the basic pigments and binder, the coating may also include flame retardants to avoid having a flammable suit. Several versions of such flame retardant coatings are possible. Some of these allow the multispectral fabric to pass flame tests, such as the US Federal Test Method Standard #191A, Method 5903. Such a coating allows the invention to be made largely of flammable materials, such as polyester or nylon, but still display a measure of flame retardance due to the coating properties. One flame retardant material that can be used is Amsperse 1023P available from Advanced Compounding, 617 W. Johnson Avenue, Chesire, Conn. 06410 U.S.

Pre-strip panel 56 is preferably rectangular in configuration with width W preferably being from 6 to 16 inches (15.2 to 40.6 cm) in length, more preferably 8 to 12 inches in length (20.3 to 30.5 cm), and more preferably of a 10 inch (25.4 cm) length on average. The longitudinal length of pre-strip panel 56 is not controlling as the panels (following the strip formation described below) can be abutted end to end or placed in a vertically staggered parallel orientation or even other variations such as angled parallel orientations, angled staggered orientations, angled intersecting (e.g., zig-zag) and random attachment—the important thing being to provide sufficient enough strip coverage to achieve the desired suppression effect of the underlying object The longitudinal length of the panels is thus governed mainly by the type of garment covering being formed and the location on that garment to which the panel is to be attached. A length of ½ to 3 feet (0.15 to 0.91 m) is suitable for most purposes of the invention.

Figure 4:
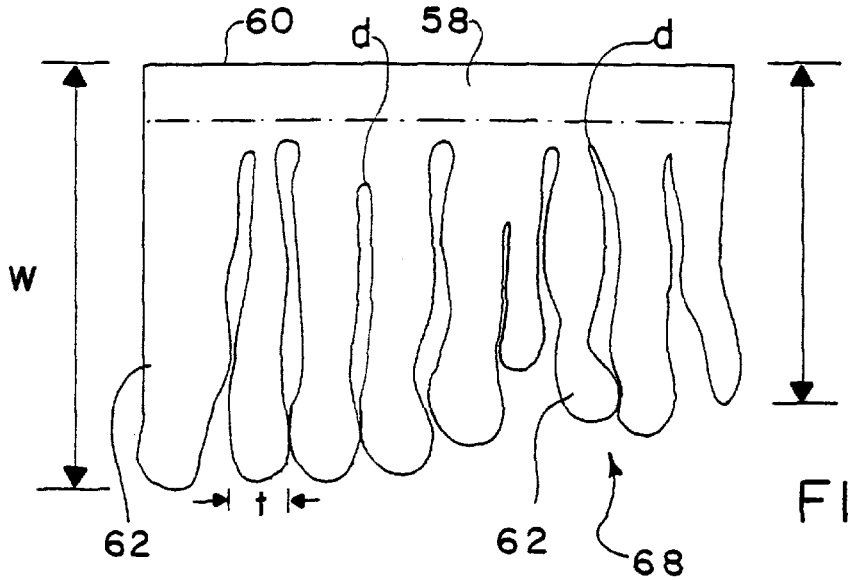
FIG. 4 shows the multispectral protection panel subsequent to dangling strip formation.
Figure 5:
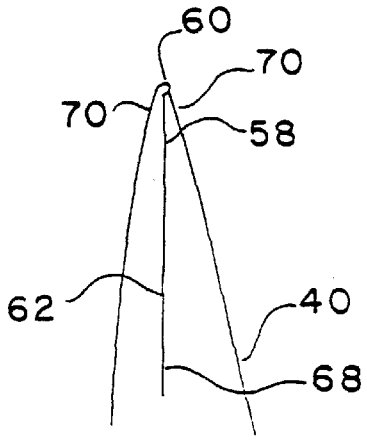
FIG. 5 shows an end view of a panel like that of FIG. 4 positioned between a folded cut-away section of undergarment material.

The dot-dash lines FIG. 3 shows pre-strip panel 56 to have a non-incision area 58 which preferably ranges in width w from ½ to 2 inches (1.27 to 5.08 cm) and more preferably equals about 1 inch (2.54 cm). Also, non-incision area 58 is preferably positioned at selvedge edge 60 of panel 56. The dashed lines illustrated in FIG. 3 represent an incision pattern to be later imparted to panel 56 for the purpose of forming dangling strips 62 (FIG. 4). The incision pattern in FIG. 3 thus differentiates strip material area 64 from excess material area 66. The incision pattern in FIG. 3 has a high amplitude (from just inward of the selvedge edge to the opposite edge), sinusoidal or meandering pattern which defines a plurality of strips. The peak and valley arrangement of the pattern is such that the deepest most incision location does not extend into non-incision area 58.

FIG. 4 shows post-strip formation panel 68 wherein a plurality of different height (variations within a maximum range of 2 inches (5.08 cm) preferred) strips 62 are shown. The sinusoidal incision pattern has shown to produce strips that more closely blend in with a foliated background than the rectangular strips used in U.S. Pat. No. 5,281,460. Also, the distance of the deepest portion d for each incised valley from the dash-dot line representing the non-incision area 58 preferably also varies randomly from valley to valley with a range of 0 to 2 inches (0 to 5.08 cm) being preferred and a random pattern as to d from valley to valley end also being preferred. Thickness t of each strip is preferably within a range of ½ to 2 inches (0 to 5.08 cm) with a majority of the strips falling within a range of 1 to 1¼ inches (2.54 to 3.15 cm) for t. In addition to the rounded free ends of each strip, at least some of the side walls of each strip are preferably also formed with a low amplitude, sinusoidal pattern which provides strips that can even more closely blend in with a foliated background. To avoid large openings in the outer-strip layer, the side contours are arranged such that a recess in one strip is offset by a protruding area in the adjacent strip. The desire to avoid undue openings in the outer strip layer also results in the low amplitude (1/16 to ¼ inch or 0.16 to 0.64 cm) in the side wall sinusoidal pattern. The formation of the sinusoidal contoured shaped strips can be accomplished by a die press or any other material cutting technique having the required degree of precision to form the contoured strips. The die-cut technique essentially avoids the removal of any excess material between the dangling strips. As the strips dangle, and twist, there is provided free areas for convection while avoiding non-coverage of the underlayer. The side can be made so as to remove some material between adjacent strips (e.g., 1/16 to ½ inch or 0.16 to 1.27 cm), but this is less preferable from a coverage standpoint, and is believed to not significantly increase convection due to the dangling nature of the strips.

After panel 68 is formed, it is secured to a section of underlayer mesh material such as mesh 30 in FIG. 1 and, more preferably, mesh 40 in FIG. 2. This is accomplished by folding a section of mesh 40 over the incised selvedge edge 58 of panel 68. This fold over arrangement is illustrated in end view in FIG. 5.

Figure 6:
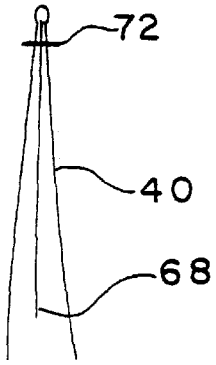
FIG. 6 shows a similar view to that of FIG. 5 except with the panel having been attached at a selvedge edge to the undergarment material.

After mesh 40 is folded over incised selvedge edge 58, selvedge edge 58 and the immediate adjacent areas of folded over section 70 of the folded over mesh 40 are secured together. A preferred manner of securement involves serging an overlock stitch 72 along the entire longitudinal length of the fold. FIG. 6 provides an end view of this securement technique. The thread used in forming stitch 72 is preferably a plastic thread such as nylon or polyester.

Figure 7:
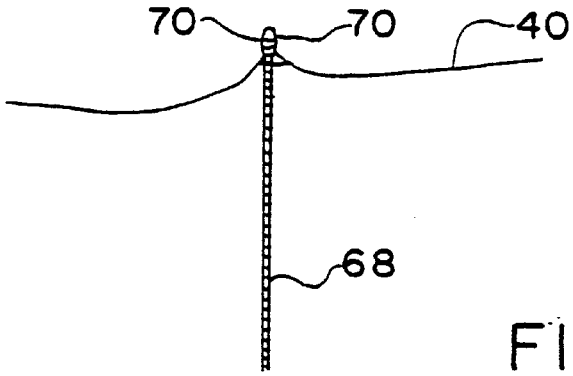
FIG. 7 shows a similar view to that of FIG. 6 except with the undergarment material reoriented from its folded over configuration to a horizontal configuration.
Figure 8:
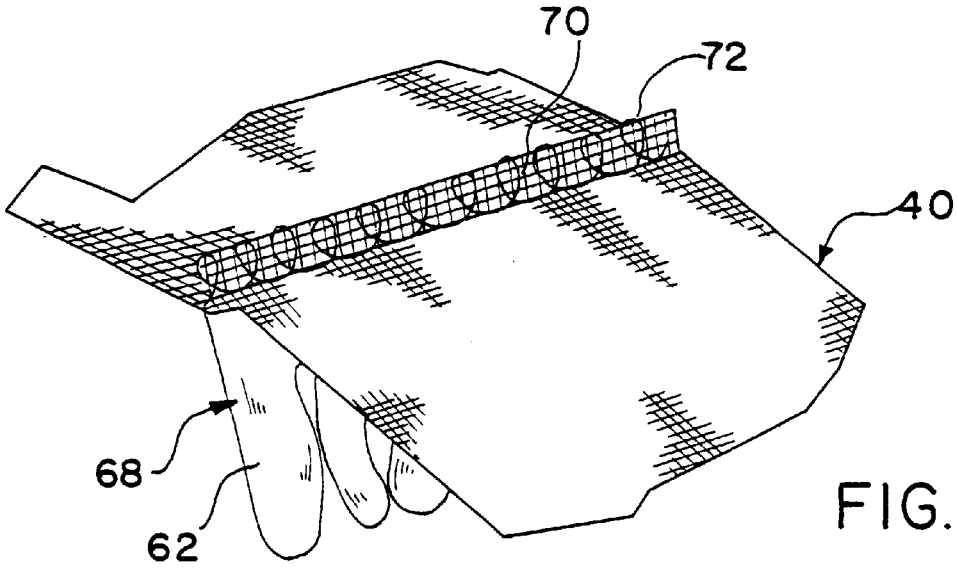
FIG. 8 shows a perspective view of that which is shown in FIG. 7.

After the serging operation is completed, the strips 62 of panel 68, upon open knit mesh material 40 being arranged horizontally, will dangle freely as illustrated in end view in FIG. 7 and as shown in perspective in FIG. 8. FIG. 8 also shows overlock stitch 72 in greater detail.

Figure 9:
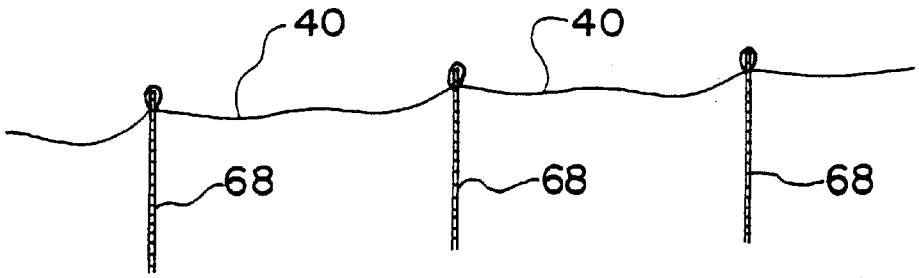
FIG. 9 shows an end view of a plurality of multispectral panels with dangling strips attached to the undergarment in a spaced series.

If one then serges additional panel strips 68 to fabric sheet 40 (or similar open mesh net or sheet) so that the overlock seams are essentially parallel, a series of dangling strips are formed in the manner illustrated in FIG. 9. The length of strip dangling vertically off from the horizontally arranged underpanel is preferably of a length equal to or plus 1 to 2 inches greater than the distance along the horizontal between seams 72. The distance between strip panels 68 along the horizontal is preferably about 6 to 12 inches (15.24 to 30.48 cm).

When the embodiment shown in FIG. 9 is rearranged such that the underlayer 40 extends vertically (as a majority of the underlayer would when formed as a personal garment), the end of the multispectral strips tend to drape over each other (provided the dangling strips are sufficiently long enough with respect to the distance between the supporting seams in the final location of usage). As shown in FIG. 10A, the resultant configuration of this combination becomes three-dimensional as the manner of attachment and strip configuration gives loft or depth to the fabric. This loft or depth is attributable to the manner of connection of the strip material to the underlying panel support, the use of a panel with selvedge edge to provide a common foundation to the multiple interconnected strips, and the degree of rigidity in the strip material itself (i.e., not of a completely drooping nature—having some relative rigidity). For example, as shown in FIG. 10A, base portion 69 of each strip extends essentially perpendicular out from the supporting underlying mesh. An extension of ¼ to 4 inches (0.64 to 10.2 cm) and more preferably ½ to 3 inches (1.27 to 7.62 cm) in an essentially perpendicular manner out from the base material and prior to initial curvature of the strip is preferable to provide the loft effect. This extension is represented by "b" in FIG. 10A. Typically, a range of 1 to 3 inches (2.54 to 7.62 cm) is utilized to provide sufficient loft to each strip. Each dangling strip also includes curved section 71 which is positioned between the essentially perpendicular base portion 69 and the vertically extending portion 73 of the strip, e.g., the portion extending perpendicular to an axis extending between a detection means and the person as well as perpendicular to the base portion of the strip. With the arrangement shown in FIG. 10A, the strips hide the open knit underlayer of fabric from direct view (e.g., strips are essentially in a side-by-side relationship so the cut is touching along a single line (e.g., cut is less than 1 mm in thickness). The strips will twist, move back and forth, and become entangled but there is little or no visibility of the underlying garment from a side of strip to side of strip viewpoint. In view of this tangling, shifting and twisting nature of the strips, the strips (attached to a common panel) can be placed in an overlapping side edge arrangement. Moreover, the loft effect adds enclosed open space 75 below each strip as shown in FIG. 10A. Thus, there is now sufficient air space between and around the strips of multispectral fabric to ensure that they are cooled convectively to within a few (e.g., 1 to 3) degrees of the ambient air. There is also sufficient free space so that the wearer's body heat can readily dissipate by freely flowing to and through the suppression strips.

FIG. 10A also shows the entire width w of panel 68 being received within fold 77 (defined by fold segments 70—70). In this way, the depth of the fold is essentially equal to the width w. This provides good support to assist in providing the transverse arrangement at the front of the underlayers 40.

FIG. 10B shows a rear view of a sectional multispectral camouflage covering 68 shown in end section in FIG. 10A. As shown in FIG. 10B, immediate adjacent areas of fold 77 attached to selvedge edges of panels, form a plurality of parallel horizontal ridges which are spaced apart laterally in parallel fashion. These ridges are preferably about 1 inch (2.54 cm) in height.

Because the suit fabric of the present invention has a much greater surface area than that afforded by any planar fabric (keeping in mind that the wearer's body still produces the same amount of heat), there is dumped the same amount of heat into a vastly larger radiant/convective area. Since the effective radiant area is increased, but the heat to be dissipated does not, the effective radiant cross-sectional area of the suit is decreased. This is the area used in determining the radiant heat exchange between the suit and a thermal sensor. That exchange is governed by the relationship:

$$Q=F\,A_cE_g$$

where Q is the heat exchanged between the suit and a thermal sensor, F is the shape factor between the two, $E_g$ is the gray body radiosity of the radiating surface, and $A_c$ is the cross-sectional area of the object (which is changed by the suit fabric).

The variable in the above equation, F, is the shape factor between the object and the thermal camera. The shape factor is essentially the geometric transfer efficiency between two surfaces—in this case, the cross-sectional area of the suit, and the entrance aperture of the thermal sensor. Shape factor F is affected by the solid areas subtended between the two surfaces, and the orientation of the radiating surface (the suit) to the collecting surface (sensor aperture). As the radiating surface rotates from being essentially parallel to being essentially perpendicular to the plane of the collecting surface, the shape factor varies from its maximum to its minimum. Therefore, bodies whose radiant area is perpendicular to the collecting area have their shape factors maximized. In the present invention by using the serged multispectral combination fabric herein described, the radiating area is substantially perpendicular and not parallel to the collecting area of the thermal sensor. Therefore, both of the variables, F and $A_c$ in the present invention provide significantly improved performance over the prior art.

Additionally, the multispectral fabric further reduces the heat transferred to the thermal sensor, by reducing the third variable in he previous equation, $E_g$ (the gray body radiosity). This variable is further described by the relationship:

$$E_g=\epsilon\sigma T^4$$

where $\epsilon$ is the emissivity of the radiating material, $\sigma$ is the Stefan-Boltzman constant, and T is the absolute temperature of the radiating body. The multispectral fabric used for the strips exhibits reduced emissivity due to its thermally-transparent coating overlying its low-emissivity aluminum (or other low-emissivity material) layer.

Thus, the detectable radiation that is sensed by a sensor is governed by $$Q=\sigma\epsilon(T_{app}{}^4, \text{suit}-T_{bkg}{}^4) \tag{1}$$

where Q represents the radiative contrast between the apparent radiative temperature of the suit and the background The suit's apparent temperature is a function of its physical temperature and emissivity (self-emission) and the apparent temperature of the objects (sky/foliage) surrounding it (the reflected component) with $$T_{app}, suit = \sqrt[4]{\epsilon_{suit}\, T_{suit}^4 + \frac{(1-\epsilon_{suit})}{Q_{suit}} T_{bkg}^4} \tag{2}$$

with $Q_{suit}$ representing the reflectivity of the suit.

The suit works by reducing (1) die surface temperature of the suit compared to previous art and, to a lesser extent, (2) a reflection of cooler ambient surroundings due to lower emissivity.

The surface temperature variation can be described as a thermal exchange balance of the convective and radiative terms.

The accumulation/loss of suit temperature is governed by the following:

$$\begin{aligned} mC_p\frac{dT_{suit}}{dt} = {} & h_oA_o(T_{amb}-T_{suit}) && + \text{(convective exchange between suit and ambient)} \\ & h_iA_i(T_{inner}-T_{suit}) && + \text{(convective exchange between suit and air around)} \\ & \sigma\in(T_{body}^4-T_{suit}^4) && + \text{(radiative exchange between body and suit)} \\ & \sigma\in(T_{amb}^4-T_{suit}^4) && + \text{(radiative exchange between suit and ambient)} \end{aligned} \tag{3}$$

The suit works by keeping surfaces as close to ambient levels as possible through the techniques of (a) Maximizing the interaction of ambient air with the suit pieces. Raising the external area $A_o$ allows any accumulated heat, $T_s$, to dissipate quickly.

(b) Avoiding a dramatic increase in the temperature close to the body, $T_{inner}$, due to air exchange with surrounding air by virtue of open mesh underlayer. A balance of "the inner" air temperature.

$$\frac{dT_{inner}}{dt} = h_iA_i(T_{body}-T_{inner}) + h_iA_i(T_{suit}-T_{inner}) + \dot{m}(T_{amb}-T_{inner}) \tag{4}$$

The higher air exchange range, $\dot{m}$, allows any heat accumulation at $T_{inner}$, that would get transferred to $T_{suit}$, to dissipate toward $T_{ambient}$. This keeps $T_{suit}$ closer to $T_{amb}$ than previous art.

Techniques (a) and (b) keep $T_{suit}$ in equation (2) and $T_{app,suit}$ in equation (1) as close to ambient or background as possible, minimizing Q or the contrast. However, an additional reduction in Q/contrast can be obtained by reflecting the cooler background (sky/foliage) reducing $T_{app,suit}$ in equation (2) and the Q in equation (1).

The aforementioned increase in area also greatly increases the convective heat transfer of heat to the ambient atmosphere. Rudimentary convection is given by:

$$Q_c=hc^\circ A\Delta T$$

where h is the coefficient of convection, A is the area of the convecting mass, and $\Delta T$ is the temperature difference between the convecting mass and the ambient air. One can readily see that by increasing the area, as in this invention there is a direct increase in the heat flow via convection. This invention can provide 2–3 times (depending on the strip length used) the convective area that a simple, planar fabric provides.

In an attempt to improve the performance of the prior art suit in U.S. Pat. No. 5,281,460, additional strips were sewn to the undergarment in an attempt to provide depth to the fabric. This proved not to be desirable. The amount of depth provided to the art by such strips was outweighed by the increased likelihood of snagging, suit bulk, and reduced airflow the added strip introduced. The current invention eliminates those strips—providing reduced weight, increased signature suppression, reduced snagging, and increased wearer comfort.

As noted above, the dangling strips are preferably comprised of a nylon or polyester fabric into which is deposited a layer of metal which is reflective in the thermal infrared. Further, the visual and near-infrared reflectance of the invention may be patterned simply by sewing strip panels of differing colors/NIR reflectance over certain parts of the suit This patterning can be used to break up the spatial continuity of the suit, so that whole sections of the suit—arms, legs, torso, head—may have differing reflectance than other parts. This spatial disruption can, in some instances, further improve the visual and near infrared suppressive effect embodied by the invention—when viewed in its entirety. For example, in some environments transforming to the same suit only with the left arm and right leg having a uniformly darker green, while the right arm is uniformly a brighter green provides for enhanced performance. In other words, this pattern disruption can make detection more difficult.

As noted, over the metal layer is placed a coating which includes a pigment or pigments which have visual and near infrared reflectance characteristics and a thermally transparent binder. Thus, the resultant strip is multispectral in quality from the standpoint that the strips are thermally reflective, colored to match environmental backgrounds (e.g., green to match a foliaged scene or light brown for sand background, etc.), and able to match the near infrared reflection of those same backgrounds.

With reference now to FIGS. 11A and 11B, there is shown one preferred underlayer garment embodiment 74 prior to strip attachment. Strip attachment can also take place prior to the assembling of one or more pattern pieces or the forming of the garment material into an undergarment configuration such as those in FIGS. 11A and 11B.

FIG. 11A shows undergarment embodiment 74 with hood 76 having face opening 78. Face opening 78 can be expanded and contracted by manipulation of a nylon drawstring (not shown) extending out about the border of the face opening.

Hood 76 is preferably a double thick portion of undergarment 74 which is integrated with the remainder of the suit or made detachable by (e.g., a plastic zipper) attached to shoulder segment 80. Shoulder segment 80 extends into arm portions 82, 84, and chest portion 86 in the front and back portion 88 in the rear (FIG. 11B). Preferably, a pair of upside down L-shaped chest protection patches 90, 92 are provided to opposite sides of front section 94. Patches 90, 92 can be formed of heavyweight canvas or a like material. Front section 94 can be closeable by a series of spaced buttons (e.g., 4 to 6 inches or 10.16 to 15.24 cm spacing) that are preferably reinforced to avoid undesirable opening of the garment. These spaced buttons are arranged on flap 95. Buttons are preferred from the standpoint of the potential noise level of velcro and zipper securement. Flap 95 extends from face opening 78 well into the crotch area of the suit.

In the elbow region of arm portions 82 and 84 are secured (e.g., stitching or adhesive) elbow pads 96, 98. Elbow pads 96, 98 are formed by sewing to the undergarment 1 inch (2.54 cm) closed cell (to avoid moisture absorption) foam encased in a dense foam layer or separate material and sewn to the undergarment fabric (or provided in a closeable pocket).

Similarly, knee pads 100, 102 are formed in the knee areas of the underlying garment. Knee pads are also preferably formed of 1 inch (2.54 cm) closed-cell foam encased and sewn to the inside surface of the underlying fabric. In the area of the feet, there are provided stirrups or cinch members 104, 106 (e.g., nylon webbing and d-rings) which help ensure maintenance of the leg portions. FIG. 11B further shows seams 112 and 114 where arm portions 82 and 84 join with back portion 88.

Figure 12A:
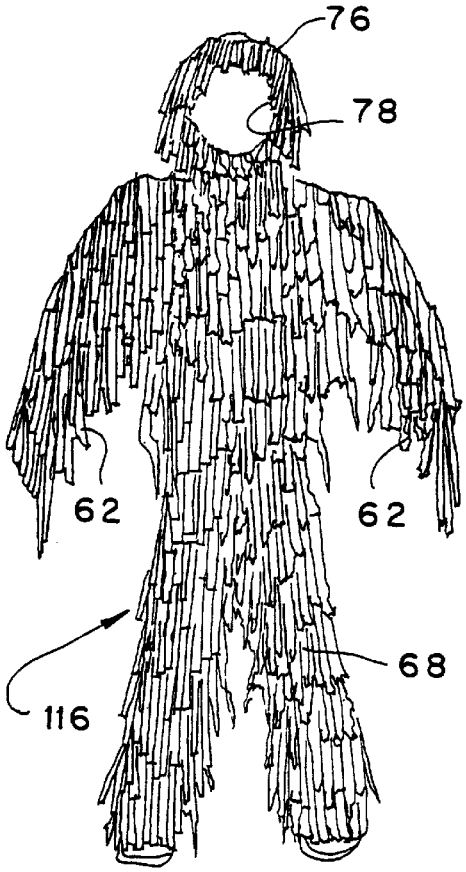
FIG. 12A shows the one-piece coverall of FIG. 11A together with added panels such as that shown in FIG. 4.
Figure 12B:
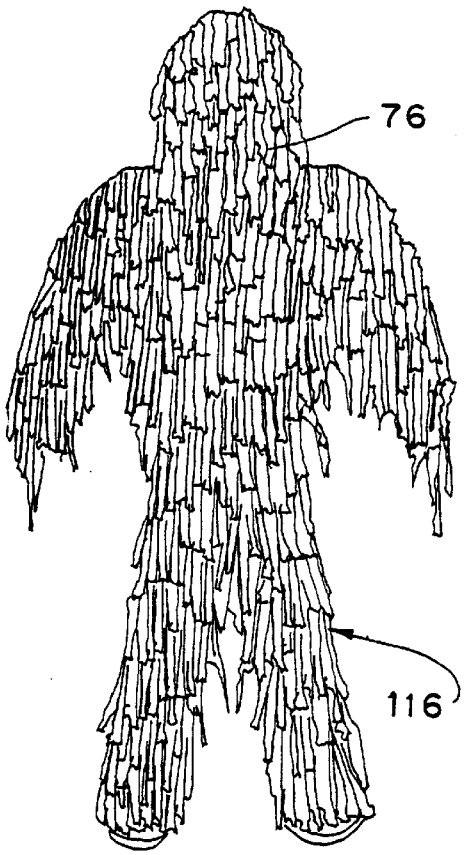
FIG. 12B shows the one-piece coverall of FIG. 11B together with added panels such as that shown in FIG. 4.

FIGS. 12A and 12B show the same view as their counterpart 11A and 11B, only with the aforementioned multispectral panels 68 with dangling strips 62 in position. A plurality of panels 68 are secured essentially over the entire undergarment configuration 74 except for face opening 78 which remains essentially open. The manner of attachment of panels 68 is similar to that which is illustrated in FIG. 10, which features a series of horizontally extending, vertically spaced plurality of panels attached to the undergarment material. Alternate arrangements are also possible, especially in the smaller regions such as the head.

The resulting one-piece coverall design 116 shown in FIGS. 12A and 12B is particularly suited for individuals who rely on slow stalking for part of their mission profile often over difficult terrain. The one-piece garment 116 is particularly suitable for maintaining signature security across the multiple spectra noted above during crawling movement and the like. In other words, garment 116 is secured on several points to the body, i.e., feet, knees, elbows, and head which are all firmly maintained covered so that no part of the wearer's body is exposed during crawling or stalking through rough country.

Figure 13A:
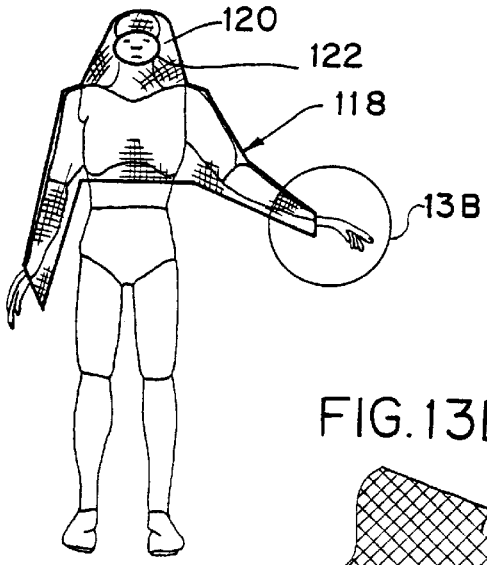
FIG. 13A shows a schematic depiction of a camail or tunic type embodiment of the present invention in position over the wearer.

FIG. 13A illustrates another preferred embodiment of an undergarment configuration which is a single piece head-and-shoulder undergarment cover 118 (camail, to use the ancient armor term) which is useful for wearers typically requiring thermal suppression only when looking up from a defilade position. As with the last embodiment, a head section 120 is provided with face opening 122 which can be contracted by way of a drawstring or the like. An elastic member or drawstring arrangement can also be provided about the waist portion of camail 118 to preclude wind flapping problems.

Figure 13B:
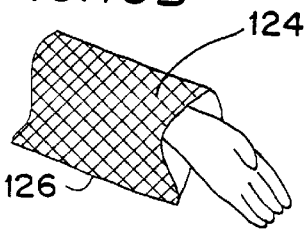
FIG. 13B shows an enlarged view of the circled area in FIG. 13A.

FIG. 13B illustrates an expanded view of the circled portion in FIG. 13A. As shown, arm portion 124 is comprised of a relatively loose fitting, folded over segment of underlying fabric which is joined at lower seam 126. An elastic strap around the wrist in combination with the aforementioned mitt is a further possibility.

Figure 13C:
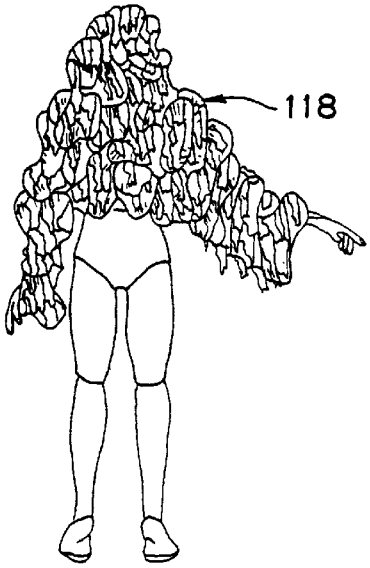
FIG. 13C shows a similar depiction as that in FIG. 13A except with added panels such as that shown in FIG. 4.

FIG. 13C illustrates the urdergarment embodiment in FIG. 13A supporting a plurality of panels 68 with dangling strips in a fashion similar to that described above for FIG. 12A.

FIGS. 14A–14G are directed at another preferred embodiment of the present invention which is poncho design 128. FIG. 14A shows in schematic fashion poncho pattern 129 for undergarment material such as underlayer fabric 40 without the hood yet attached. Poncho design 128 provides a versatile, general purpose suppressive garment for regular; infantry personnel and the like. Poncho design 128 can readily cover an individual and all that individual's packed gear.

FIG. 14B illustrates poncho design 128 with strip panels 68 secure thereto in the manner described above with the hood down. FIG. 14C illustrates that which is shown in FIG. 14B, except with hood 131 in position on the wearer's head. FIG. 14D provides a rear view of that which is shown in FIG. 14C.

The main sheet forming poncho pattern 129 can be modified as shown in FIGS. 14E–14G to double as a suppressant blanket or as a camouflage covering for other objects. FIG. 14E illustrates poncho pattern 129 (formed of porous underlayer material 40, for example) laid flat. With a central zipper half-section 130 (or button/extended loop arrangement) for doubling both as a hood attachment and as a means for closing up the head insertion hole in the poncho. Zipper half-section 130 includes a suitable zipper runner 133 for attachment to a corresponding half-section in a hood to be attached or with its corresponding opposite end 135. The removable hood 132 is shown in FIG. 14F and 14G, with 14F providing a front view and FIG. 14G the rear view.

As shown in FIG. 14F, removable hood 132 has front face opening 134 defined by border region 136 which supports a nylon drawstring 138 with securement member 140 for locking draw string 138 at its desired location. Hood 132 also features button edge 142 with zipper half extension 144 extending thereabout. Zipper half extension 144 includes break 146 which features respective ends of a zipper track. The opposite (plastic) zipper half section 133 is provided about head hole 148 and upon pulling runner 133 with end 135 inserted, hole 148 can be closed following removal of hood 132 (as illustrated in lashed lines in FIG. 14E). Poncho 128 can thus double as a blanket or camouflage covering for another object when the hole is closed off. A suitable sized pocket (not shown) can be provided as the interior of poncho 128 for storing hood 132 when not in use.

Figure 15A:
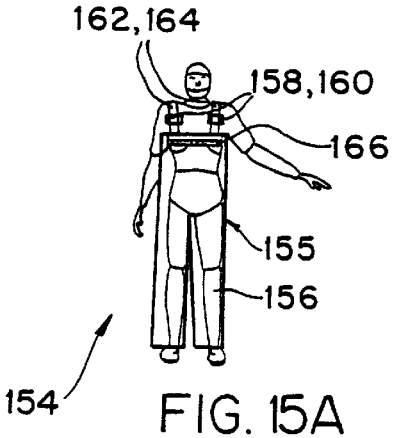
FIG. 15A shows a schematic depiction of a lower piece of a 2-piece coverall embodiment of the present invention in position on a wearer.
Figure 15B:
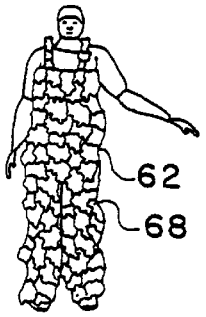
FIG. 15B shows a similar depiction of that which is shown in FIG. 15A except with multispectral suppression panels attached.
Figure 15C:
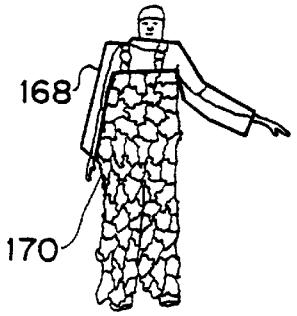
FIG. 15C shows a similar depiction of that which is shown in FIG. 15B except with the upper, second piece of the two-piece coverall design shown schematically in position on the wearer.
Figure 15D:
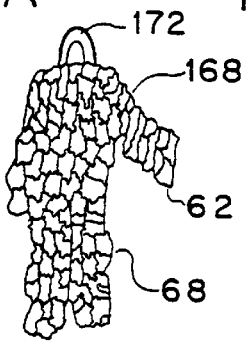
FIG. 15D shows a similar depiction as that in FIG. 15C except with panels added to the second piece of the two piece coverall design as well as an added hood which is schematically shown in position over the wearer's head.
Figure 15E:
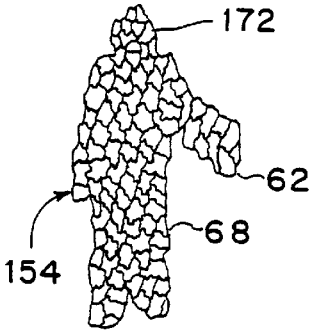
FIG. 15E shows the same depiction as that in FIG. 15D except with panels in position on the hood.

FIGS. 15A and 15E illustrate still another garment made possible by the versatile design of the underlayer material/suppression strip combination of the present invention. The camouflage covering shown in FIGS. 15A–E are in the form of a two-piece coverall design 154 (or three-piece if a detachable hood is utilized). Coverall design 154 (FIG. 15E) is designed to provide a better suppressive effect than the poncho embodiment, but more freedom of movement and versatility than the aforementioned one-piece coverall design.

FIG. 15A illustrates, in schematic form, first piece 155 of the two piece coverall 154 which is comprised of pants 156 with supporting suspender straps 158, 160 which are preferably supported by a side release suspender buckles 162, 164. To enhance the fitting of pants 156 to a plurality of different sized individuals, elastic chest seam 166 is provided as shown in FIG. 15A. FIG. 15B shows pants 156 with suppressive panels 68 with strips 62 attached (the inner nylon webbing suspenders being fee of any strips).

FIG. 15C shows schematically the second piece 168 of the two-piece coverall 154 which is a pullover with integral hood combination. Preferably drawstring 170 extends about the lower edge of pullover 168 in the waist area to approximate the coverage of the one piece design.

FIG. 15D shows the embodiment of FIG. 15C with dangling strips 62 covering the pullover except for the integral hood 172 of the pullover 168 being free of strips for illustrative purposes.

FIG. 15E illustrates the final form of two-piece coverall design 154 with complete strip arrangement.

The strength and increased dimensional stability of the preferred undergarment material and the effectiveness of the covering strips in the present invention also allows for the inclusion of several types of additional garment features without sacrificing signature suppression performance. Examples of some possible added garment feature can be seen in FIGS. 18A and 18B with respect to one piece coverall design 74 shown in FIGS. 11*a* and 11B. The attachments described below can also be utilized in other suit or garment configurations. Each of the below mentioned attachments are positioned and supported inside or on the interior surface of the undergarment.

FIGS. 18A and 18B illustrate an adjustable suspension assembly 174 which can be used to provide individual adjustments to make the garment more universal with respect to potential users. Suspension assembly 174 comprises front strip half sections 176, 178 on the right shoulder side and half sections 180, 182 on the left shoulder side. D-ring adjusters 175, 177 are used to adjustably secure the nylon webbing half sections 176 and 178 together and 180 and 182 together. Half sections 176 and 180 are secured at one end (e.g., a sewn attachment) to the undergarment material while sections 178 and 182 extend over webbing shoulder pads 181, 183 (which is preferably looped for facilitating proper positioning of sections 178 and 182). Sections 178 and 182 extend over the shoulders of the wearer and come to common attachment point 184 at one end of vertical strip 186. The opposite end of strip 186 is secured to adjustable web belt 188 which includes nylon buckle or cinch 190 at the front.

FIG. 18B also illustrates cargo pockets 192, 194 (inside back) which are sized to support a container and meal ready to eat (MRE) package. In addition, loop 196 is provided to support other ancillary equipment. Various other attachments are also possible (although not shown) such as various buttons or drawstrings for donning the garment or attaching ancillary equipment (night vision goggles, for instance).

As a further example, a system of straps are provided at the cuffs of the legs to ensure that the suit remains firmly attached to the feet. The cuffs are deliberately made large so that they completely cover most wearer's feet. This is in preference to separate foot covers—which can easily get lost or torn, and are awkward to attach and stay in place. In addition, cinching straps are provided at both knees and both elbows to further secure the suit on the wearer. It is undesirable for the suit to ride up at any place—thus exposing the skin or underclothing to detection by thermal sensor. The two cargo pockets are sewn into the inside of the garment so that, when worn, they ride just at kidney level. As noted, these pockets are sized to hold two MRE's and/or two 2-quart canteens.

For even greater signature suppression, the areas not completely covered by the aforementioned garments such as the hands and face can be covered. During the building and testing of a prototype suit, there was uncovered a problem in the overall design that had not been anticipated. This problem was that during use of the suit, the wearer occasionally needed to look directly at the thermal sensor to ensure proper positioning. During such activity, the thermal sensor could detect the signature of the wearer's eye and face. To overcome this problem, a face suppression mask was developed with one embodiment of a suitable mask 198 being shown in FIGS. 16A and 16B.

Figure 16A:
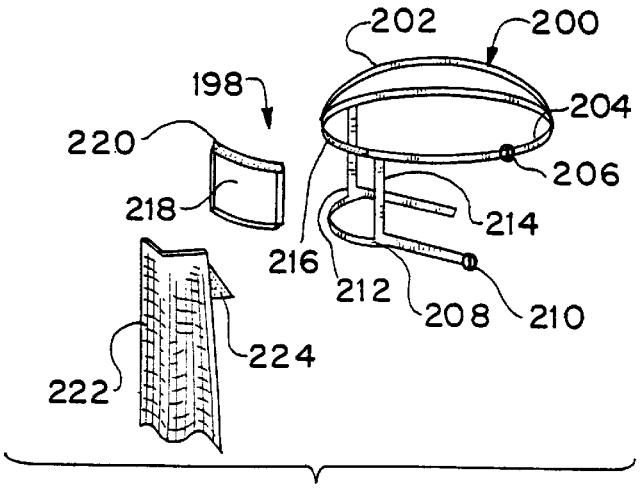
FIG. 16A shows, in perspective, the components used in forming one embodiment of a face mask of the present invention.
Figure 16B:
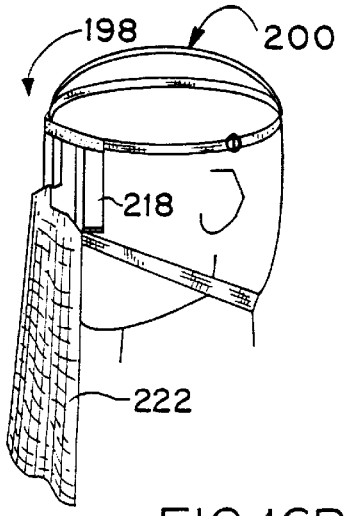
FIG. 16B shows the face mask of FIG. 16A in position on the wearer.

As shown in FIGS. 16A and 16B, mask 198 includes head harness (e.g., nylon webbing) assembly 200 comprised of top cross-section 202, side head section 204, D-ring cinch 206, below nose section 208 with D-ring cinch 210, and vertical side face sections 212, 214 each extending between sections 208 and 204 on opposite sides of the nose so as to define a rectangular frame arrangement. Along the upper section of the frame arrangement is provided securement device 216 which is preferably one-half of a velcro attachment assembly. To various sections of the harness, assembly 200 can also be provided with added velcro attachment segments for added head sizing versatility.

Securement device 216 supports clear vinyl shield 218. Shield 218 is vinyl so as to be transparent in the visual wavebands, but essentially opaque in the thermal infrared range. Shield 218 is provided with a convex configuration with side flanges such that, when a complementary securement device 220 on shield 218 attaches with securement device 216, shield 218 stands well off the face so as to avoid fogging due to the wearer's breath leaking in (it is also possible to include a foam seal along the edge of the flange and/or added securement for further protection from fogging, although it is also desirable to have some means for heat escape behind the shield to avoid the trapping of heat behind the shield.

Although not shown, over shield 218 a series of netting and multispectral strip layers can be attached to break up the visual, near infrared and thermal signature of the face and eyes. The strips can be spaced so as to still enable a sight line therebetween or some can be temporally brushed to the side by the user. Secured to the lower edge of the frame arrangement as to shield 218 itself is veil 222. Veil 222 is preferably formed of the same underlayer material described above together with a plurality of dangling strips (not shown) secured thereto. Breath pad 224 of insulating foam (like that described above) is sewn to the veil to prevent the viewer's breath from unduly heating the material (to avoid the thermal detection). With the mask in place, the wearer can stare directly at the thermal sensor without being detected.

FIG. 17 illustrates suppressive mitt 226 which provides signature suppression for the hand, yet does not unduly limit manual dexterity. Mitt 226 has a back portion that duplicates the construction techniques of the suit (underlayer material/strip combination, preferably extending off a common selvedge base). The palm area 228 of the mitt, rather than the combination above, is formed of a fabric material such as heavy canvas (10–16 oz). This material provides protection for the wearer during crawling and permits the grasping of limbs, rocks, and other rough, uneven surfaces without damaging the suit or hand. Slit 228 is provided in the palm so the user can poke all four fingers out at will. Another slit or a canvas thumb (mitten-like) extension can be provided for the thumb. Rather than the slit, the mitt can also include glove-like finger extensions with outer combination covering and inner canvas layer protection.

As seen from the foregoing, a central principle of the invention is to reduce the apparent temperature of a wearer by utilizing the combination of low-emissivity material, increased radiant area, and geometric dispersal of thermal radiation (shape factor) by the use of a composite fabric that provides a loft effect due to the "hollow" depth of the material. This hollow depth serves to disperse the radiation, while allowing the heat generated by the wearer to be dissipated at a rate comparable to a human not clad. Any fabric in which depth is provided by strips of fabric, threads, etc. that are so constructed to project: away from the plane of a porous under fabric is considered an embodiment of this invention. In place of the relatively wide dangling strips, the present invention is also directed at an embodiment watch uses relatively large diameter threads or yarns to replace the wide, flat strips so that the entire suit fabric can be machine made (such as knitted on a double needle bed knitting machine). The use or low-emissivity materials is not essential to this invention, but enhances the signature suppressive effects. By using low emissivity material (e.g., an emissivity below 0.50 and more preferably below 0.20 such as many polished metals which fall below a 0.1 emissivity value), one reduces the required density of strips—thus lightening the garment made of the fabric. Further, the strip material may be of uniform color or near infrared reflectivity, or it can be patterned so that each strip in a panel exhibits different or multiple colors. Additionally, patches of strips over the body of the invention may be made up of essentially uniform, differing colors. This is most effective if entire portions of the suit (arm, leg, torso, or head) are so colored (the term color as used here applies to both visual and near infrared reflectivity). As noted, the suit may be made of relatively flammable materials, yet still display non-flammability if the thermally-transparent coating of the multispectral fabric contains high loadings of flame retardant. Conversely, the coating may not contain flame retardant, but the suit still may display inherent non-flammability if the invention is constructed of non-flammable fabrics such as NOMEX material or self-extinguishing acrylic. Also, the reference to "strips" in the present application is used in a broad sense to cover numerous configurations such as ribbons, filaments, relatively large diameter yarn segments, etc.

Although the present invention ho; been described with reference to preferred embodiments, the invention is not limited to the details thereof. Following a review of the disclosure of the present invention, various substitutions and modifications will occur to those of ordinary skill in the art, and all such substitutions and modifications are intended to fall within the spirit and scope of the invention as defined in the appended claims.

What is claimed is:

1. A camouflage covering, comprising:

a porous underlayer that provides for convective transfer of air therethrough;

a plurality of strips each having a base portion that is joined to and extends essentially transversely out from said porous underlayer and said strips having a free end section that is free from contact with said underlayer and which extends away from said base portion out over said underlayer and toward an adjacent strip so as to provide a lofted covering effect, and said strips essentially covering the porous underlayer so as to present a camouflage covering that has depth.

2. A covering as recited in claim 1, wherein said porous underlayer is a mesh material having more than a 50% planar open area.

3. A covering as recited in claim 2, wherein the planar open area is about 90% or greater.

4. A covering as recited in claim 3 wherein said porous underlayer is a knitted fabric.

5. A covering as recited in claim 1 wherein said porous underlayer is shaped as a personal garment.

6. A covering as recited in claim 5 wherein said covering is a one-piece coverall with hood covering.

7. A covering as recited in claim 5 wherein said covering is a two piece coverall with hood.

8. A covering as recited in claim 5 wherein said covering is a tunic with hood.

9. A covering as recited in claim 5 further comprising an attachment device positioned on an interior surface of the underlayer which is the surface most adjacent a wearer of the covering.

10. A covering as recited in claim 9 wherein said attachment device is a size adjustment assembly.

11. A covering as recited in claim 9 wherein said attachment device includes a closed cell cushion.

12. A covering as recited in claim 5 wherein said personal garment comprises a mitt which is comprised of said underlayer and a plurality of said strips.

13. A covering as recited in claim 5 further comprising a mask which includes a face shield which provides visual acuity and thermal suppression of the eyes and at least a portion of a wearer's face, said mask further comprising a head securement assembly and a plurality of said strips.

14. A covering as recited in claim 13 wherein said face shield includes a vinyl plate and a breath suppression device.

15. A covering as recited in claim 5 wherein said covering further comprises a hood and means for securing said hood to said underlayer, and said means for securing said hood also including means for closing a head opening in said underlayer providing head access to said hood whereby said covering doubles as a blanket or general object covering when the hood is removed and the head opening closed.

16. A covering as recited in claim 1 wherein said strips are received by said underlayer while in an essentially transverse orientation with respect to said underlayer to avoid covering openings in said underlayer and said base extends essentially transversely directly out away from said underlayer for a distance of at least ½ inch (1.27 cm) and said strips are of a sufficient length and rigidity so as to curve and place the free end section essentially perpendicular to the base portion and to partially cover over an adjacent positioned strip.

17. A covering as recited in claim 16 wherein said strips are formed of a laminated multispectral material which includes a base fabric layer, an intermediate low emissivity layer and thermally transmissive outer layer with the outer layer including means for matching the strips with visual and near infrared reflectance characteristics of an environmental background in which said covering is to be used, and said intermediate layer being of thermally reflecting material for presenting an appearance of lower emissivity when viewed through the thermally transparent outer layer.

18. A covering as recited in claim 17 wherein said low emissivity layer is a metallic layer, and said thermally transmissive outer layer is applied over the metallic layer.

19. A covering as recited in claim 17 wherein said outer layer includes a binder material and said matching means includes color pigment or pigments having a particle size below 3 micrometers.

20. A covering as recited in claim 1 wherein said strips have a common base so as to form a multi-strip panel, and said common base being secured within a fold of said underlayer so as to extend essentially transversely with respect to a front surface of said underlayer.

21. A covering as recited in claim 20 wherein said covering comprises a plurality of said panels which are secured within a plurality of folds in said underlayer with a plurality of panel supporting folds being arranged so as to form a plurality of ridges on an interior surface of said underlayer.

22. A covering as recited in claim 20 wherein said strips are formed from a common sheet of material with a depth of incision between adjacent strips being different within the common sheet and said strips having side edges that are concave and convex.

23. A method of forming a camouflage covering comprising securing a plurality of strips to a porous underlayer such that the strips have a base portion that extends out perpendicularly to said underlayer and said strips having a free end section that extends away from said base portion, out over said underlayer and to a position adjacent another strip so that said strips provide a lofted covering effect with respect to said underlayer.

24. A method as recited in claim 23 wherein a plurality of said strips extend from a common edge and securing said strips includes positioning the common edge within a fold of said underlayer and fixing said common edge within that fold of material, and, when said porous underlayer is arranged vertically, the free ends of said strips extending from said common edge extend vertically downward into a vertically overlapping relationship with strips positioned therebelow.

25. A method as recited in claim 24 wherein a plurality of independent common edges each with strips are secured within a plurality of folds that are arranged in spaced fashion.

26. A method as recited in claim 23 further comprising forming one or more panels of strips with a common base along one edge by subjecting a panel of material to an incision operation with the incisions extending internally to the common base.

27. A method as recited in claim 23 further comprising forming said strips with a low emissivity internal layer and an outer coating having a thermally transparent binder material with a pigment interdispersed within the coating that provides the coating with an ability to match the strips with visual and near infrared reflectance characteristics on an environmental background in which said covering is to be used.

28. A camouflage covering, comprising:

a porous underlayer, a plurality of strips supported by said porous underlayer and dimensioned and arranged so as to form a three-dimensional composite fabric that reflects and converts a main direction of thermal radiation from perpendicular to parallel with respect to a plan of an entrance aperture of a thermal sensor and includes a free flow convective space between an interior surface of said strips and an exterior surface of said porous underlayer by way of a loft arrangement in said strips.

29. A camouflage covering as recited in claim 28 wherein said loft arrangement features strips that include a base portion that extends essentially transverse with respect to the supporting underlayer for at least ½ inch (1.27 cm) and which features an outer portion that curves away from said base portion and into a parallel arrangement with the supporting underlayer and with the plan of a thermal sensor.

30. A camouflage covering as recited in claim 29 wherein groups of said strips are provided with each group of strips extending out from a common base section formed of a common material and said groups of strips being joined to said porous underlayer by inserting said common base thereof within one or more folds formed in said porous layer and securing the common base to the fold formed in said porous layer.

31. A camouflage covering, comprising:

a porous layer having at least a 90% open area; and a plurality of elements supported by said porous layer that freely dangle when said porous layer is oriented vertically.

32. A camouflage covering as recited in claim 31 wherein said porous layer is a knit mesh comprised of strands of plastic.

33. A camouflage covering as recited in claim 1 wherein said strips are formed of a flame retardant material.

34. A method of forming a multispectral camouflage material comprising:

applying a coating layer onto a supporting material, which applied coating includes a pigment material, a thermally transparent binder material within which the pigment material is dispersed, an emulsifier, and a solvent, and wherein applying the coating layer onto the supporting material includes coating with a binder that is a thermally transparent polymer that is applied over the supporting material which is reflective to the thermal infrared.

35. A method as recited in claim 34 wherein said supporting material has a coated surface having an emissivity value below 0.50, and said thermally transparent polymer is an acrylic polymer.

36. A method as recited in claim 34 wherein said applied coating further comprises an added flame retardant, and weight ranges for ingredients in the applied coatings are as follows:

| | |
|---|---|
| Pigment(s) | 35–40% |
| Acrylic Polymer | 20–30% |
| Binder and solvent | |
| Flame Retardant | 35–40% |
| Emulsifier | .08–.15% |

37. A camouflage covering, comprising:

a porous underlayer having more than a 50% planar open area; and a plurality of strips supported by said underlayer, said strips having a base portion extending out away from said underlayer, a free end section, and a curve section intermediate said base section and free section, and each free end section being in a more co-planer relationship with said underlying support than said base section and extending adjacent to another strip such that said strips provide a lofted covering effect with respect to said porous underlayer.

38. A camouflage covering as recited in claim 37 wherein said base portion of said strips extends generally transverse to said underlayer and to opposite sides of a front face of said underlayer, and the free ends of said strips extend generally co-planar with said underlayer into an overlapping relationship with respect to an adjacent strip.

39. A camouflage covering as recited in claim 1 wherein the base portion of said strips extends to opposite sides of a plane defined by a front surface of said underlayer.

40. A camouflage covering as recited in claim 39 wherein there are groups of said strips that extend from common edge sections with said common edge sections being received within folds formed in said underlayer.

41. A camouflage covering as recited in claim 31 wherein said porous layer is formed of so as to include hexagonal shaped openings that are defined by single loop sides.

42. A method as recited in claim 34 further comprising cutting said supporting material into a plurality of groups of strips of materials with the strips in each group sharing a common edge.

* * * * *